US010202675B2

(12) United States Patent
Sagara et al.

(10) Patent No.: US 10,202,675 B2
(45) Date of Patent: Feb. 12, 2019

(54) DUPLEX STAINLESS STEEL

(71) Applicant: NIPPON STEEL & SUMITOMO METAL CORPORATION, Chiyoda-ku, Tokyo (JP)

(72) Inventors: Masayuki Sagara, Tokyo (JP); Akiko Tomio, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 901 days.

(21) Appl. No.: 14/406,978

(22) PCT Filed: Jun. 19, 2013

(86) PCT No.: PCT/JP2013/066844
§ 371 (c)(1),
(2) Date: Dec. 10, 2014

(87) PCT Pub. No.: WO2013/191208
PCT Pub. Date: Dec. 27, 2013

(65) Prior Publication Data

US 2015/0152530 A1 Jun. 4, 2015

(30) Foreign Application Priority Data

Jun. 22, 2012 (JP) ..... 2012-140365

(51) Int. Cl.

| | |
|---|---|
| ***C22C 38/44*** | (2006.01) |
| ***C21D 8/10*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |

(52) U.S. Cl.
CPC ..... *C22C 38/44* (2013.01); *C21D 8/10* (2013.01); *C21D 8/105* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/42* (2013.01); *C21D 2211/001* (2013.01); *C21D 2211/005* (2013.01)

(58) Field of Classification Search
CPC ..... C22C 38/44
See application file for complete search history.

(56) References Cited

U.S. PATENT DOCUMENTS

| | | | | |
|---|---|---|---|---|
| 4,141,762 | A | 2/1979 | Yamaguchi | |
| 5,284,530 | A * | 2/1994 | Azuma | C22C 38/00 148/325 |
| 5,298,093 | A * | 3/1994 | Okamoto | C22C 38/001 148/325 |

FOREIGN PATENT DOCUMENTS

| | | |
|---|---|---|
| CA | 2743741 | 6/2010 |
| CN | 1412337 | 4/2003 |
| CN | 101429629 | 5/2009 |
| CN | 102770572 | 11/2012 |
| EP | 0220141 | 4/1987 |
| EP | 0534864 | 3/1993 |
| EP | 0545753 | 6/1993 |
| EP | 1722002 | 11/2006 |
| JP | 05-132741 | 5/1993 |
| JP | 10-006079 | 1/1998 |
| JP | 11-080901 | 3/1999 |
| JP | 2001-262287 | 9/2001 |
| JP | 2002-146470 | 5/2002 |
| JP | 2004-360035 | 12/2004 |
| JP | 2005-501969 | 1/2005 |
| JP | 2012-082488 | 4/2012 |
| WO | 0164969 | 9/2001 |

OTHER PUBLICATIONS

Office Action dated Apr. 12, 2016 issued in corresponding Canadian Application No. 2875644.
Search Report dated Feb. 1, 2016 issued in corresponding European Application No. 13806836.6.
International Search Report dated Jul. 23, 2013 issued in corresponding PCT Application No. PCT/JP2013/066844 [with English Translation].
Office Action dated Nov. 4, 2015 issued in corresponding Chinese Application No. 201380031907.8.

* cited by examiner

*Primary Examiner* — Christopher S Kessler
(74) *Attorney, Agent, or Firm* — Birch, Stewart, Kolasch & Birch, LLP.

(57) ABSTRACT

A stainless steel contains, by mass %, C: 0.005% to 0.03%, Si: 0.05% to 1.0%, Mn: 0.1% to 4.0%, Ni: 3% to 8%, Cr: 20% to 35%, Mo: 0.01% to 4.0%, Al: 0.001% to 0.30%, N: 0.05% to 0.60%, one or more selected from Re: 2.0% or less, Ga: 2.0% or less, and Ge: 2.0% or less, and a balance consisting of Fe and impurities.

2 Claims, No Drawings

DUPLEX STAINLESS STEEL

TECHNICAL FIELD OF THE INVENTION

This application is a national stage application of International Application No. PCT/JP2013/066844, filed Jun. 19, 2013, which claims priority to Japanese Patent Application No. 2012-140365, filed on Jun. 22, 2012, each of which is incorporated by reference in its entirety.

The present invention relates to a duplex stainless steel, and particularly to a duplex stainless steel having excellent localized corrosion resistance against pitting corrosion and crevice corrosion.

RELATED ART

Since a duplex stainless steel leas excellent corrosion resistance, particularly, excellent seawater corrosion resistance, the duplex stainless steel is widely used as material for offshore structures such as heat exchanger pipes, oil well pipes used in oil wells or gas wells, or line pipes.

Among corrosive environments, in an environment containing chloride ions such as a seawater environment, in which the above-described offshore structures are used, it is necessary to pay attention to localized corrosion such as pitting corrosion and crevice corrosion. There is a possibility that a through hole is formed resulting from the localized corrosion loss by pitting or crevice corrosion of a material and that stress corrosion cracking is propagated from the pitting or the crevice corrosion which is the initiation site, which are important problems.

In consideration of the above-described problems, various duplex stainless steels in which localized corrosion resistance is improved have been developed. For example, in Patent Document 1, there is disclosed a duplex stainless steel having excellent stress corrosion cracking resistance by adjusting an amount of B contained appropriately according to an amount of N and an amount of Ni in a γ-phase (austenite).

In Patent Document 2, there is disclosed a high-strength duplex stainless steel having high strength and high corrosion resistance, excellent thermal structural stability, and excellent stress relieving corrosion resistance in which steel is not sensitized or embrittled even in a typical welding operation or a stress relieving treatment with an active addition of W.

In Patent Document 3, there is disclosed a duplex stainless steel having excellent pitting corrosion resistance in which amounts of Cr, Mo, and N in austenite are adjusted. Further, in Patent Document 4, there is disclosed a duplex stainless steel having both high corrosion resistance and excellent mechanical properties in which structures of both ferrite and austenite and element distribution thereof are adjusted.

PRIOR ART DOCUMENT

Patent Document

[Patent Document 1] Japanese Unexamined Patent Application, First Publication No. 2004-360035

[Patent Document 2] Japanese Unexamined Patent Application, First Publication H5-132741

[Patent Document 3] Japanese Unexamined Patent Application, First Publication H11-80901

[Patent Document 4] Published Japanese Translation No. 2005-501969 of the PCT International Publication

DISCLOSURE OF THE INVENTION

Problems to be Solved by the Invention

The duplex stainless steels disclosed in Patent Documents 1 to 4 have high corrosion resistance. However, in recent years, there has been an increasing demand for a product that resists more severe corrosive environments and further improved corrosion resistance has been required.

The present invention is made in consideration of the above circumstances. An object of the present invention is to provide a duplex stainless steel having excellent localized corrosion resistance against pitting corrosion, and crevice corrosion.

Means for Solving the Problem

The present inventors have conducted various extensive studies on a method for improving localized corrosion resistance of a duplex stainless steel. As a result, the present inventors have found that when Re, Ga, or Ge is contained in a duplex stainless steel, the critical potential at which pitting corrosion occurs (pitting corrosion potential) increases and pitting corrosion resistance and crevice corrosion resistance are significantly improved. The present invention has been completed based on such findings and the gist thereof is a duplex stainless steel shown in the following (1) and (2).

(1) According to an embodiment of the present invention, there is provided a duplex stainless steel containing, by mass %, C: 0.005% to 0.03%, Si: 0.05% to 1.0%, Mn: 0.1% to 4.0%, Ni: 3% to 8%, Cr: 20% to 35%, Mo: 0.01% to 4.0%, Al: 0.001% to 0.30%, N: 0.05% to 0.60%, one or more selected from Re: 2.0% or less, Ga: 2.0% or less, and Ge: 2.0% or less, and a balance consisting of Fe and impurities.

(2) The duplex stainless steel according to (1) may further contain, by mass %, one or more elements selected from the following first group and second group in place of a part of the Fe.

First group: W: 6.0% or less and Cu: 4.0% or less

Second group: Ca: 0.01% or less, Mg: 0.01% or less, and REM: 0.2% or less

Effects of the Invention

The duplex stainless steel of the present invention has excellent resistance to localized corrosion such as pitting corrosion and crevice corrosion (localized corrosion resistance). Therefore, the duplex stainless steel can be suitably used as material for offshore structures such as heat exchanger pipes, oil well pipes used in oil wells or gas wells, or line pipes, which have a problem of corrosion in a severe corrosive environment.

EMBODIMENTS OF THE INVENTION

Hereinafter, a duplex stainless steel according to an embodiment of the present invention will be described.

1. Chemical Composition

The reasons for limiting each element are as follows. In the following description, "%" indicting the amount of each element represents "mass %".

C: 0.005% to 0.03%

When the amount of C is more than 0.03%, Cr carbide is formed at the grain boundary, which results in increased corrosion susceptibility at the grain boundary. Therefore, the upper limit of the amount of C is set to be 0.03%. The upper limit of the amount C is preferably 0.02%. On the other hand, in order to ensure the strength of the steel, the lower limit of the amount of C is preferably 0.005%.

Si: 0.05% to 1.0%

Si is an element effective as a deoxidizer for an alloy. In order to obtain the effect, the lower limit of the amount of Si is preferably 0.05%. However, when the amount of Si is more than 1.0%, the hot workability is deteriorated. Therefore, the upper limit of the amount of Si is set to 1.0%. The upper limit of the amount of Si is preferably 0.5%.

Mn: 0.1% to 4.0%

Mn is, like Si, an element effective as a deoxidizer for an alloy. In order to obtain the effect, the lower limit of the amount of Mn is preferably 0.1%, and more preferably 0.3%. However, when the amount of Mn is more than 4.0%, the hot workability is deteriorated. Therefore, the upper limit of the amount of Mn is set to 4.0%. The upper limit of the amount of Mn is preferably 2.0% and more preferably 1.2%.

Ni: 3% to 8%

Ni is an austenite stabilizing element and an element essential for the duplex stainless steel. However, when the amount of Ni is less than 3%, a sufficient effect cannot be obtained. On the other hand, when the a count of Ni is more than 8%, an appropriate balance between ferrite and austenite cannot be obtained. Accordingly, the amount of Ni is set to 3% to 8%. The lower of the amount of Ni is preferably 3.5%.

Cr: 20% to 35%

Cr is an element necessary for obtaining a ferrite structure or the duplex less steel and is also an element essential for improving the pitting corrosion resistance of the duplex stainless steel. In order to obtain suitable pitting corrosion resistance, it is necessary to set the lower limit of the amount of Cr to be 20%. On the other hand, when the amount of Cr is more than 35%, the hot workability is deteriorated. Accordingly, the amount of Cr is set to 20% to 35%. The amount of Cr is preferably 21% to 28%.

Mo: 0.01% to 4.0%

Mo is, like Cr, an element having an effect of improving the pitting corrosion resistance, and it is necessary to set the lower limit of the amount of Mo to be 0.01%. On the other hand, when the amount of Mo is more than 4.0%, the material workability during production is deteriorated. Accordingly, the amount of Mo is set to 0.01% to 4.0%. The amount of Mo is preferably 1.0% to 3.5%.

Al: 0.001% to 30%

Al is an element effective as a deoxidizer. In addition, Al has an effect of preventing Si or Mn from forming oxides, which are harmful to hot workability, by fixing oxygen. In order to obtain the above-described effect, the lower limit of the amount of Al is preferably 0.001%, and more preferably 0.01%. Accordingly, when the amount of Al is more than 0.30%, the hot workability is deteriorated. Thus, the upper limit of the amount of Al is set to 0.30%. The upper limit of the amount of Al is preferably 0.20%, and more preferably 0.10%.

N: 0.05% to 0.60%

N is an element which improves the austenite stability and also improves the pitting corrosion resistance and crevice corrosion resistance of the duplex stainless steel. In addition, N has, like C, an effect of stabilizing austenite and improving the strength. However, when the amount of N is less than 0.05%, a sufficient effect cannot be obtained. On the other hand, when the amount of N is more than 0.60%, the toughness and the hot workability are deteriorated. Accordingly, the amount of N is set to 0.05% to 0.60%. In order to obtain higher strength, the lower limit of the amount of N is preferably more than 0.17%, and is more preferably 0.20%. Further, the upper limit of the amount of N is preferably 0.35%, and more preferably 0.30%.

One or more mole selected from Re: 2.0% or less, Ga: 2.0% or less, and Ge: 2.0% or less Re, Ga, and Ge are elements which significantly improve the pitting corrosion resistance and crevice corrosion resistance. However, when the amount of each element is more than 2.0%, the corrosion resistance improving elect is saturated. In addition, when the amount of each element is more than 2.0%, the hot workability is deteriorated. Accordingly, the amounts of Re, Ga, and Ge are set to 2.0% or less. The amount of each element is preferably 1.0% or less. In order to obtain the corrosion resistance improving effect, the amounts of Re, Ga, and Ge are preferably 0.01% or more, more preferably 0.03% or more, and still more preferably 0.05% or more. Only any one of Re, Ga, and Ge may be contained or two or more of these elements may be contained in combination. When these elements are contained in combination, the total amount of these elements is preferably 4% or less.

When Re, Ga, and Ge are contained in the duplex stainless steel, the pitting corrosion resistance of the duplex stainless steel is improved. As the reason for that, it is assumed that Re, Ga, and Ge improve the passive film formed in a corrosive environment, and thus, the propagation of the pitting is suppressed in the process from the pit initiation to the development thereof and passivation is promoted. When any element of Re, Ga, and Ge is used, the same effect can be obtained. However, Re has a particularly significant effect.

The duplex stainless steel according to the embodiment contains the above-described respective elements and a balance consisting of Fe and impurities. Here, the term of "impurities" represents elements that are mixed from ore and scrap used as a raw material or the production environment when stainless steel is produced industrially. The impurity elements are not particularly limited. However, it is preferable to limit the amounts of P and S to the following amount or less. The reasons for limiting the amounts of P and S will be described below.

P: 0.040% or less

P is an impurity element that is unavoidably mixed in the steel. The smaller the amount of P is, the more preferable it is. When the amount of P is more than 0.040%, the corrosion resistance and the toughness may be significantly deteriorated. Accordingly, the amount of P is preferably 0.040% or less.

S: 0.020% or less

S is, like P, an impurity element that is unavoidably mixed in the steel. The smaller the amount of S is, the more preferable it is. When the amount of S is more than 0.020%, the hot workability may be significantly deteriorated. Accordingly, the amount of S is preferably 0.020% or less.

In order to further improve the strength, the corrosion resistance, and the hot workability, the duplex stainless steel according to the embodiment may further contain one or more elements selected from the following first group and second group, in place of part of Fe.

First group: W: 6.0% or less and Cu: 4.0% or less

Second group: Ca: 0.01% or less, Mg: 0.01% or less, and REM: 0.2% or less

W: 6.0% or less

W is, like Mo, an element which improves the pitting corrosion resistance and the crevice corrosion resistance. In addition, W is an element which improves the strength by solute strengthening. Therefore, in order to obtain the effect, W may be contained as necessary. In order to obtain the above-described effect, the lower limit of the amount of W is preferably 0.5%. In order to obtain a duplex stainless steel having higher strength, the lower limit of the amount of W is more preferably 1.5%. On the other hand, when an excessive amount of W is contained, a σ-phase is easily precipitated and the toughness may be deteriorated. Therefore, when W is contained, the upper limit of the amount of W is set to 6.0%.

Cu: 4.0% or less

Cu is an element which improves corrosion resistance and grain boundary corrosion resistance. Therefore, Cu may be contained as necessary. In order to obtain the above-described effect, the lower limit of the amount of Cu is preferably 0.1%, and more preferably 0.3%. However, when the amount of Cu is more than 4.0%, the effect may be saturated and the hot workability and the toughness may be deteriorated. Therefore, when Cu is contained, the upper limit of the amount of Cu is set to 4.0%. The upper limit of the amount of Cu is more preferably 3.0%, and still more preferably 2.%.

Ca: 0.01% or less

Ca is an element effective in improving the hot workability. In order to obtain the effect, Ca may be contained as necessary. In order to obtain the above-described effect, the lower limit of the amount of Ca is preferably 0.0005%. However, when the amount of Ca is more than 0.01%, coarse oxides are thrilled and the hot workability may be deteriorated. Therefore, when Ca is contained, the upper limit of the amount of Ca is set to 0.01%.

0.01% or less

Mg is, like Ca, an element effective in improving the hot workability and may be contained as necessary. In order to obtain the above-described effect, the lower limit of the amount of Mg is preferably 0.0005%. However, when the amount of Mg is more than 0.01%, coarse oxides are thrilled and the hot workability may be deteriorated. Therefore, when Mg is contained, the upper limit of the amount of Mg is set to 0.01%.

REM: 0.2% or less

REM is, like Ca and Mg, an element effective in improving the hot workability and may be contained as necessary. In order to obtain the above-described effect, the lower limit of the amount of REM is preferably 0.001%. However, when the amount of REM is more than 0.2%, coarse oxides are formed and the hot workability may be deteriorated. Therefore, when REM is contained, the upper limit of the amount of REM is set to 0.2%. Here, the REM is a general term of 17 elements including 15 lanthanoid elements and Y and Sc.

The duplex stainless steel having the above-described compositions can be formed into a steel pipe by a known method.

Hereinafter, the present invention will be described in more detail by referring to examples. However, the present invention is not limited by the examples and various design modifications can be made within a range not departing from the gist of the present invention.

EXAMPLES

Each of steel Nos. 1 to 25 having chemical compositions shown in Table 1 was melted by use of a 50 kg vacuum melting furnace. The obtained ingot was heated at 1200° C., forged, hot-rolled, and formed into a material having a thickness of 5 mm.

TABLE 1

| Steel | Chemical composition (mass %, balance consisting of Fe and impurities) | | | | | | | | | | | | | | | | Vc'100 (mV vs. | |
|---|---|---|---|---|---|---|---|---|---|---|---|---|---|---|---|---|---|---|
| No. | C | Si | Mn | P | S | Cu | Ni | Cr | Mo | W | Al | N | Re | Ga | Ge | Others | SCE) | Remarks |
| 1 | 0.017 | 0.46 | 1.00 | 0.016 | 0.001 | 0.50 | 7.0 | 24.7 | 2.0 | 2.0 | 0.004 | 0.31 | — | — | — | — | −31 | Comparative |
| 2 | 0.017 | 0.48 | 1.00 | 0.017 | 0.001 | 0.52 | 7.1 | 21.0 | 3.0 | 2.0 | 0.005 | 0.30 | — | — | — | — | −50 | Examples |
| 3 | 0.017 | 0.46 | 1.02 | 0.016 | 0.001 | 0.48 | 7.2 | 25.1 | 1.5 | 2.0 | 0.027 | 0.30 | — | — | — | — | −51 | |
| 4 | 0.017 | 0.46 | 1.05 | 0.013 | 0.001 | 0.50 | 7.2 | 24.8 | 3.1 | 0.5 | 0.029 | 0.31 | — | — | — | — | −5 | |
| 5 | 0.017 | 0.48 | 1.02 | 0.013 | 0.001 | 0.47 | 7.2 | 23.1 | 2.5 | 2.0 | 0.029 | 0.25 | — | — | — | — | −62 | |
| 6 | 0.032 | 0.46 | 1.06 | 0.016 | 0.001 | 0.98 | 7.7 | 24.8 | 1.9 | 1.6 | 0.008 | 0.24 | — | 0.30 | — | — | −24 | |
| 7 | 0.019 | 0.49 | 1.02 | 0.019 | 0.001 | 0.76 | 8.5 | 23.2 | 2.5 | 1.4 | 0.015 | 0.31 | 0.25 | — | — | — | −35 | |
| 8 | 0.016 | 0.47 | 1.04 | 0.020 | 0.001 | 0.48 | 6.9 | 18.8 | 3.2 | 0.7 | 0.027 | 0.22 | — | — | 0.19 | — | −90 | |
| 9 | 0.017 | 0.52 | 0.99 | 0.015 | 0.001 | 0.71 | 7.2 | 24.1 | — | 2.3 | 0.013 | 0.29 | 0.17 | — | — | — | −102 | |
| 10 | 0.016 | 0.50 | 1.01 | 0.021 | 0.001 | 1.54 | 7.4 | 25.5 | 1.8 | 0.9 | 0.004 | 0.03 | — | 0.83 | — | — | −70 | |
| 11 | 0.016 | 0.47 | 1.01 | 0.016 | 0.001 | 0.51 | 7.2 | 25.1 | 3.1 | 2.1 | 0.002 | 0.30 | 0.67 | — | — | — | >800 | Examples |
| 12 | 0.016 | 0.49 | 1.03 | 0.017 | 0.001 | 0.49 | 7.1 | 25.1 | 3.0 | 2.0 | 0.015 | 0.31 | 0.29 | — | — | Ca: 0.0010 | 258 | |
| 13 | 0.017 | 0.50 | 1.03 | 0.016 | 0.001 | 0.50 | 7.0 | 25.0 | 3.0 | 2.0 | 0.032 | 0.32 | 0.10 | — | — | — | 179 | |
| 14 | 0.016 | 0.55 | 0.98 | 0.019 | 0.001 | 1.70 | 7.2 | 24.0 | 3.1 | — | 0.005 | 0.34 | 0.03 | 0.02 | — | — | 121 | |
| 15 | 0.016 | 0.48 | 1.01 | 0.017 | 0.001 | 0.50 | 7.1 | 25.0 | 3.0 | 2.1 | 0.002 | 0.30 | 0.02 | — | — | Mg: 0.0020 | 63 | |
| 16 | 0.016 | 0.48 | 1.01 | 0.017 | 0.001 | 0.50 | 7.1 | 25.0 | 3.0 | 2.1 | 0.002 | 0.30 | — | 0.08 | — | — | 40 | |
| 17 | 0.017 | 0.51 | 0.97 | 0.019 | 0.001 | 1.60 | 6.2 | 23.5 | 3.5 | 1.8 | 0.007 | 0.28 | 0.22 | 0.15 | 0.34 | Y: 0.0020 | 328 | |
| 18 | 0.016 | 0.48 | 1.01 | 0.017 | 0.001 | 0.50 | 7.1 | 25.0 | 3.0 | 2.1 | 0.002 | 0.30 | — | — | 0.07 | — | 70 | |
| 19 | 0.019 | 0.50 | 1.05 | 0.018 | 0.001 | 0.30 | 4.7 | 20.8 | 3.7 | 2.3 | 0.016 | 0.35 | — | 0.27 | — | — | 209 | |
| 20 | 0.017 | 0.49 | 1.03 | 0.021 | 0.001 | 1.80 | 7.3 | 26.8 | 0.4 | 4.5 | 0.024 | 0.25 | — | 0.21 | 0.40 | — | 114 | |
| 21 | 0.015 | 0.53 | 1.00 | 0.017 | 0.001 | 0.78 | 3.8 | 25.9 | 2.8 | 2.5 | 0.009 | 0.37 | 0.15 | — | 0.21 | — | 384 | |
| 22 | 0.015 | 0.47 | 1.01 | 0.016 | 0.001 | 0.50 | 7.1 | 25.1 | 3.1 | 2.1 | 0.007 | 0.29 | — | 1.67 | — | — | 244 | |
| 23 | 0.017 | 0.48 | 1.03 | 0.016 | 0.001 | — | 5.9 | 24.5 | 2.9 | 1.9 | 0.007 | 0.30 | — | — | 1.87 | — | 125 | |
| 24 | 0.016 | 0.51 | 0.99 | 0.002 | 0.001 | — | 6.5 | 25.7 | 3.2 | — | 0.008 | 0.37 | 0.13 | — | — | — | 187 | |
| 25 | 0.015 | 0.47 | 1.03 | 0.015 | 0.001 | — | 6.8 | 25.4 | 2.9 | — | 0.006 | 0.39 | 0.08 | — | — | REM: 0.009 | 89 | |

Next, solution heat treatment was performed on the obtained material at 1070° C. for 5 minutes and then a test sample (having a diameter of 15 mm and a thickness of 2 mm) for corrosion resistance evaluation was prepared by machining.

The obtained test sample was used for measuring the pitting corrosion potential in a 20% NaCl solution at 90° C. The measurement was performed under the experimental conditions and procedures according to JIS G0577 (2005) except for the test temperature and the NaCl concentration.

In Table 1, the measurement results of the pitting corrosion potential Vc'100 of each steel were shown together. As seen from Table 1, steel Nos. 11 to 25, which are examples of the present invention, have a higher pitting corrosion potential Vc'100 and more excellent pitting corrosion resistance compared to steel Nos. 1 to 5, which are comparative examples not containing any of Re, Ga, and Ge, and steel Nos. 6 to 10 in which the amount of any one of C, Ni, Cr Mo, and N is out of the range of the present invention. When the pitting corrosion potential Vc'00 is high, the crevice corrosion resistance is also excellent.

In the table, "-" indicates that the content is equal to the measurement limit or less.

INDUSTRIAL APPLICABILITY

The duplex stainless steel of the present invention has excellent resistance to localized corrosion such as pitting, corrosion and crevice corrosion. Therefore, the duplex stainless steel can be suitably used as material for offshore structures such as heat exchanger pipes, oil well pipes used in oil wells or gas wells, or line pipes, which have a problem of corrosion in a severe corrosive environment.

The invention claimed is:

1. A duplex stainless steel comprising, by mass %:

C: 0.005% to 0.03%;

Si: 0.05% to 1.0%;

Mn: 0.1% to 4.0%;

Ni: 3% to 8%;

Cr: 20% to 35%;

Mo: 0.01% to 4.0%;

Al: 0.001% to 0.30%;

N: 0.05% to 0.60%;

one or more selected from Re: 0.01% to 2.0% and Ge: 0.01% to 2.0%;

optionally Ga: 0.01% to 2.0%; and a balance consisting of Fe and impurities.

2. The duplex stainless steel according to claim 1, further comprising, by mass %:

one or more elements selected from the following first group and second group in place of a part of the Fe, First group: W: 6.0% or less and Cu: 4.0% or less Second group: Ca: 0.01% or less, Mg: 0.01% or less, and REM: 0.2% or less.

* * * * *